United States Patent [19]

Osmanski et al.

[11] Patent Number: 4,934,168

[45] Date of Patent: Jun. 19, 1990

[54] DIE ASSEMBLY FOR AND METHOD OF FORMING METAL END UNIT

[75] Inventors: Thomas S. Osmanski, St. Charles; Jeffrey A. Dresden, Algonquin, both of Ill.

[73] Assignee: Continental Can Company, Inc., Norwalk, Conn.

[21] Appl. No.: 354,293

[22] Filed: May 19, 1989

[51] Int. Cl.[5] ..... B21D 51/44

[52] U.S. Cl. ..... 72/348; 72/336

[58] Field of Search ..... 72/329, 336, 348, 349

[56] References Cited

U.S. PATENT DOCUMENTS

| | | | |
|---|---|---|---|
| 4,109,599 | 8/1978 | Schultz | 113/121 C |
| 4,516,420 | 5/1985 | Bulso, Jr. et al. | 72/329 |
| 4,549,424 | 10/1985 | Bulso, Jr. et al. | 72/329 |
| 4,571,978 | 2/1986 | Taube et al. | 72/349 |
| 4,587,825 | 5/1986 | Bulso, Jr. et al. | 72/329 |
| 4,587,826 | 5/1986 | Bulso, Jr. et al. | 72/329 |
| 4,606,472 | 8/1986 | Taube et al. | 220/66 |
| 4,713,958 | 12/1987 | Bulso, Jr. et al. | 72/336 |
| 4,715,208 | 12/1987 | Bulso, Jr. et al. | 72/348 |

*Primary Examiner*—Lowell A. Larson

*Attorney, Agent, or Firm*—Charles E. Brown; Paul Shapiro; Charles A. Brown

[57] ABSTRACT

This relates to special tooling for forming metal end units for use in conjunction with cans for carbonated beverages and the like wherein the formed end unit is provided with an integral reinforcement in the form of a countersink so as to increase the buckle strength of such an end unit when it is formed of thin metal. Previously there has been developed tooling for forming such an end unit which, while it is commercially satisfactory, did not produce end units having the required buckle resistance. That tooling has been modified by changing the configuration of a punch core so as to eliminate a previously formed cylindrical extension of the end unit chuck wall and a countersink starter. The punch core cooperates with a die core to clamp a center panel of a formed end unit shell so as to move the center panel reversely of its forming direction and to effect a folding of an outer peripheral portion of the center panel in a lower part of the previously formed chuck wall into the required countersink.

9 Claims, 3 Drawing Sheets

DIE ASSEMBLY FOR AND METHOD OF FORMING METAL END UNIT

This invention relates in general to new and useful improvements in the formation of metal end units for cans, and more particularly to a metal end unit which may be formed utilizing a minimum of metal while having sufficient strength to meet the required container internal pressures. The metal end unit is particularly adapted for use in packaging carbonated beverages and the like.

The end unit which is the subject of this invention is distinguished in that it is provided with a countersink surrounding the center panel within the chuck wall. An early developed such end unit is disclosed in the patent to Schultz, U.S. Pat. No. 4,109,599 granted Aug. 29, 1978. In accordance with the Schultz patent, an aluminum end unit is first formed as a shell in a first set of tooling and is thereafter transferred to a second set of tooling wherein a center panel of such shell is moved axially relative to a peripheral seaming flange with the metal surrounding the center panel buckling to form the desired countersink. However, the tooling of this patent did not prove satisfactory to many for commercial purposes.

Subsequent to the Schultz invention, different tooling was developed by Metal Box of England with the resulting grant to Taube et al of U.S. Pat. Nos. 4,571,978 on Feb. 25, 1986 and 4,606,472 on Aug. 19, 1986. While the tooling of these patents did permit a single set of tooling to form the desired end unit, other tooling was developed by Redicon Corporation of Canton, Ohio followed by the grant to Bulso, Jr. et al of U.S. Pat. Nos. 4,516,420; 4,587,825; 4,587,826 and 4,715,208. In accordance with these patents, the punch core was provided at the bottom thereof with a peripheral projection which in the formation of the shell for the end unit, the desired countersink was initiated. The tooling specifically disclosed in Bulso, Jr. U.S. Pat. No. 4,715,208 was purchased and trials run therewith. However, in accordance with this tooling, when the chuck wall of the shell was formed, the chuck wall had a lower cylindrical portion while the upper portion is of a frustoconical configuration. Thus these two portions were in angular relation to one another and intersected along a circular line. In the reformation of such a shell so as to increase the depth of the countersink, the cylindrical portion of the chuck wall was eliminated. However, the chuck wall was still weakened at the previous line of intersection and the desired strength of the end unit was not commercially obtainable with the desired metal thickness.

Another difficulty encountered with the tooling of Bulso, Jr. et al U.S. Pat. No. 4,715,208 was that in the formation of the shell the metal was drawn around the annular projection at the bottom face of the punch core with the resultant thinning of the metal in that area.

As is clearly explained in the Schultz patent, the metal end unit must have a certain buckle strength for a specific use. Most specifically, the buckle strength of an aluminum end unit for use in conjunction with a can for the packaging of carbonated beverages and the like is 90 psi. Unfortunately, end units of the selected wall thickness and aluminum stock formed in accordance with Bulso, Jr. et al U.S. Pat. No. 4,715,208 was found to have a buckle strength just below 90 psi.

At this time it is pointed out that the tooling and the method of forming metal end units clearly differs among the Schultz, Taube et al and Bulso, Jr. patents. Further, the utilization of such tooling differs with Schultz utilizing two sets of toolings, Taube et al holding the center panel stationary and utilizing outer tooling to form the shell and thereafter form the countersink while Bulso, Jr. et al specifically utilizes a countersink initiating punch core.

In accordance with this invention, while the basic tooling of Bulso, Jr. et al 4,715,208 has been utilized, the punch core thereof has been modified so as to eliminate the lower cylindrical portion of the chuck wall and the initiation of the countersink. However, when the shell is being formed utilizing the new punch core, the punch core at the end of the shell forming stroke of the punch core, corroborates with a lower die core to clamp the center panel of the shell, after which while the seaming flange of the shell is held stationary, the punch core and the die core are moved in the reverse direction of the shell forming movement of the punch core while clamping the center panel therebetween so as to effect the buckling of the metal of the shell surrounding the die core to form the required countersink. It has been found that by modifying the Bulso, Jr. et al tooling the buckle strength of the resultant end unit has increased two to three psi so as to bring the buckle strength of the end unit up to that required for commercial production.

It has been found that by eliminating the impression encircling the outer extremity of the countersink radius due the initial formation of the chuck wall in two angularly related portions, the tendency of the end unit to fail by buckling is greatly reduced. Further, because the metal is drawn around a radius at the bottom of the punch core of Bulso, Jr. et al end unit, the possibility of metal thickening in the countersink, as taught by Schultz U.S. Pat. No. 4,109,599 has been precluded.

Further, it has been found that the combination of the pre-form and the transition with the Bulso, Jr. et al tooling does not allow the countersink radius to be formed into a true radius. In the Bulso, Jr. et al shell, the countersink radius is slightly deformed.

On the other hand, as opposed to by tightly clamping the center panel between the punch core and the die core, and by holding the chuck wall against its forming die and moving in unison the punch core and die core, it has been found that the center panel remains centered and the flow of metal from the center panel to form the countersink uniform as opposed to the non-clamping of the center panel in accordance with Schultz U.S. Pat. No. 4,109,599 and the holding of the center panel stationary as taught in the Taube et al patents.

With the above and other objects in view that will hereinafter appear, the nature of the invention will be more clearly understood by reference to the following detailed description, the appended claims, and the several views illustrated in the accompanying drawings.

Figure 1:
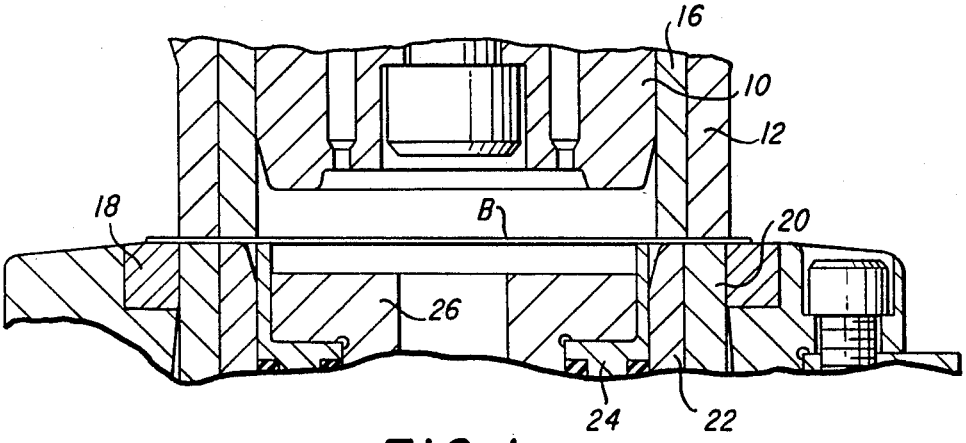
FIG. 1 is a fragmentary sectional view showing the tooling at the start of the forming operation with a blank clamped in place.

It is to be understood that the drawings of this application follow closely the drawings of Bulso, Jr. et al U.S. Pat. No.4,715,208 and differ therefrom in the configuration of a punch core and the effect of that change in configuration on the method of forming an end unit. Accordingly, reference may be had to Bulso, Jr. et al U.S. Pat. No. 4,715,208 for further structural details of the tooling to which this invention relates. Further, the tooling of this invention may be utilized in a conventional press, such as that disclosed in Ridgway U.S. Pat. No. 3,902,347.

Referring now to the drawings in detail, it will be seen that starting at the top center there is a punch core 10 which will be actuated by an inner ring (not shown) to which the punch core 10 is secured by means of a punch core holder (not shown). The tooling at the top next includes an outermost punch shell 12 that is carried by an outer ring (not shown) by way of a punch shell retainer 14.

Radially inboard from the punch shell 12 is a first pressure sleeve 16 which has one or more pistons (not shown) disposed above it and which act on the pressure sleeve 16 in response to fluid pressure. It is to be understood that the pressure sleeve 16 is relatively movable with respect to both the punch shell 12 and the punch core 10.

The tooling includes a base which carries a cut edge 18. Radially inboard of the cut edge 18 is a second pressure sleeve 20 which is fluidly supported on the tooling base in opposed relationship to the punch shell 21.

Still further radially inwardly is a die core ring 22 which is fixedly supported on the base. Yet further inboard is a knock-out piston 24 which is fluidly supported on the base for separate movement.

The die core ring 22 is disposed opposite the first pressure sleeve 16 while the knock-out piston 24 is disposed opposite the periphery of the punch core 10.

A die core 26 completes the tooling area of the base with the die core 26 being movable relative to the base 60 by a piston (not shown).

Figure 5:
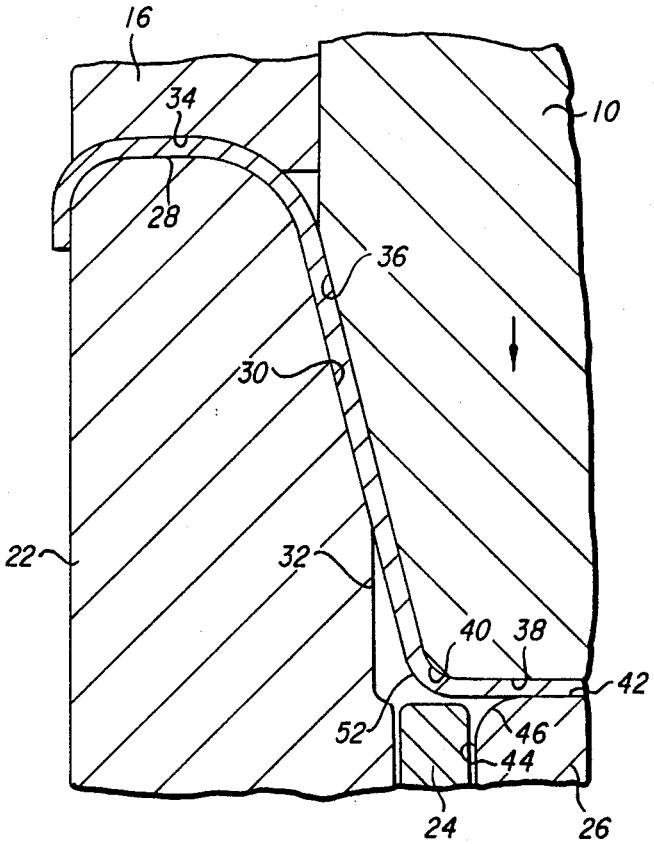
FIG. 5 is an enlarged fragmentary vertical sectional view taken through a portion only of the tooling and shows the specific configuration of the shell as formed.

Referring now to FIG. 5, it will be seen that the die core ring 22 has a specific geometry with the upper end having a radiused nose 28 which leads to a downwardly and inwardly tapering wall 30 which may terminate in a lower straight wall 32.

It will also be seen that the pressure sleeve 16 has a contoured lower face including a recessed portion 34 which is generally complimentary to the radiused nose 28.

It will also be seen that the punch core 12 has a tapered lower body portion providing a tapered side wall 36 which opposes and is parallel to the tapering wall 30 of the die core ring 22. The side wall 36 extends substantially to a bottom face 38 of the punch core 10 and is connected to the face 38 by a radius 40.

Finally, the die core 26 is provided with an upper face 42 which opposes the face 38 of the punch core 10. The die core 26 is provided with a cylindrical side wall 44 which opposes the knock-out piston 24. The cylindrical side wall 44 is joined to the face 42 by way of a radius 46.

Referring now to FIG. 1, it will be seen that a prescribed blank B of sheet metal (preferably aluminum) has been inserted into the press, either in sheet form or from a coil of material and is clamped between the upper and lower halves of the tooling. Most specifically, the blank B is clamped between the punch shell 12 and the pressure sleeve 62 on the one hand and the pressure sleeve 16 and the die core ring 22 on the other hand with the punch shell 12 and the pressure sleeve 16 having moved downwardly as indicated by the arrows.

Figure 2:
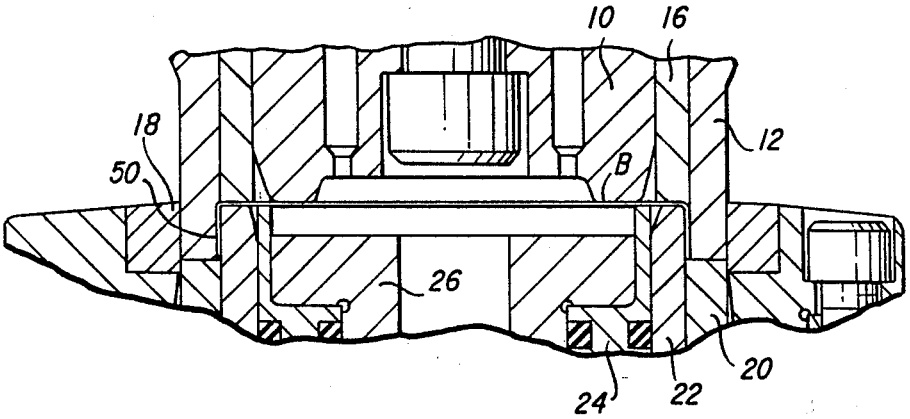
FIG. 2 is a sectional view similar to FIG. 1 and shows the tooling advanced to draw in a peripheral portion of the blank.

Further advancement of the tooling will lead to the blanking of the blank B against the cut edge 18 followed by wiping of the peripheral edge of the cut blank about the periphery of the top of the die core ring 22 so as to form what might be called an inverted or reverse cup as is illustrated in FIG. 2. The wiped peripheral edge of the cut blank is identified by the numeral 50.

It will be noted also here that the punch core 10 has advanced so that it has just come into contact with the top surface of the center part of this reverse cup. It will be further noted that the punch shell 12 has overcome the fluid pressure supporting the second pressure sleeve 20, but that the die core ring 22 is fixed and remains in place.

Figure 3:
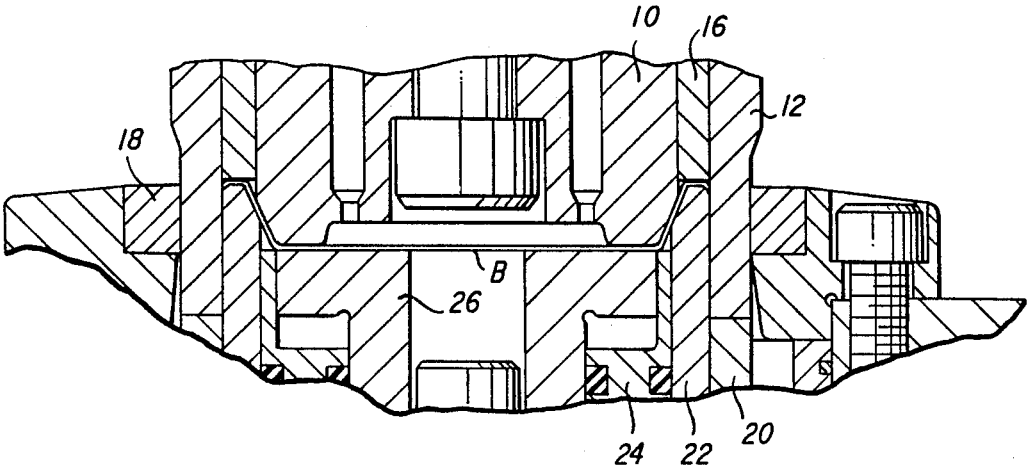
FIG. 3 is another fragmentary sectional view showing the tooling actuated to form the end unit shell.
Figure 4:
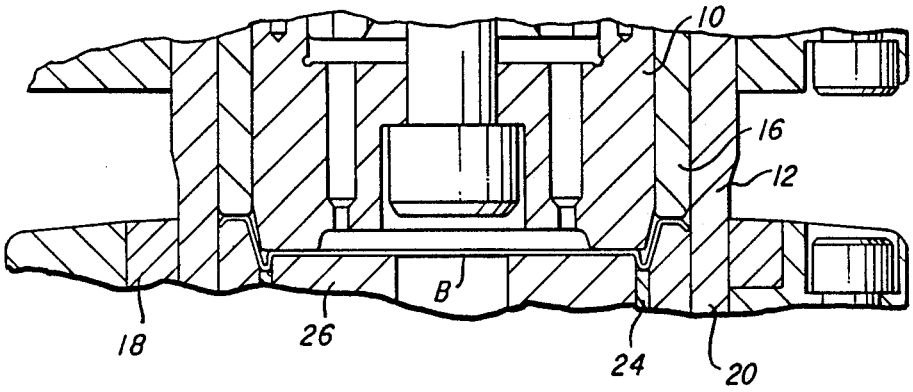
FIG. 4 is another fragmentary vertical sectional view showing movement of the tooling to reform the shell and form the countersink.

The result of further advancement of the tooling can be seen in FIG. 3 wherein the punch core 10 has continued its downward advance in the direction of the arrows and it has forced the die core 26 down. At this point, the center panel CP of the end unit has been preliminarily formed as is best shown in the enlarged view of FIG. 5.

From FIG. 5 it can be seen that the tapered wall 36 of the punch core 10 has formed the chuck wall CW in cooperation with the tapered wall 30 of the fixed die core ring 22. It is also to be noted, at this point, that the first pressure sleeve 16 is holding, and has held, the blank material against the top of the die core ring 22, so as to control the metal during the forming operation which results in a precisely dimensioned wall without wrinkles. It also should be noted, at this point, that the upper part wall CW is essentially in its final configuration at this stage and will not change and will not be affected by subsequent operations.

It is to be particularly noted that the bottom face 38 of the punch core 10 is of a larger diameter than the top face 42 of the die core 26. Thus the center panel CP as now formed is of a larger diameter than its ultimate diameter.

Figure 6:
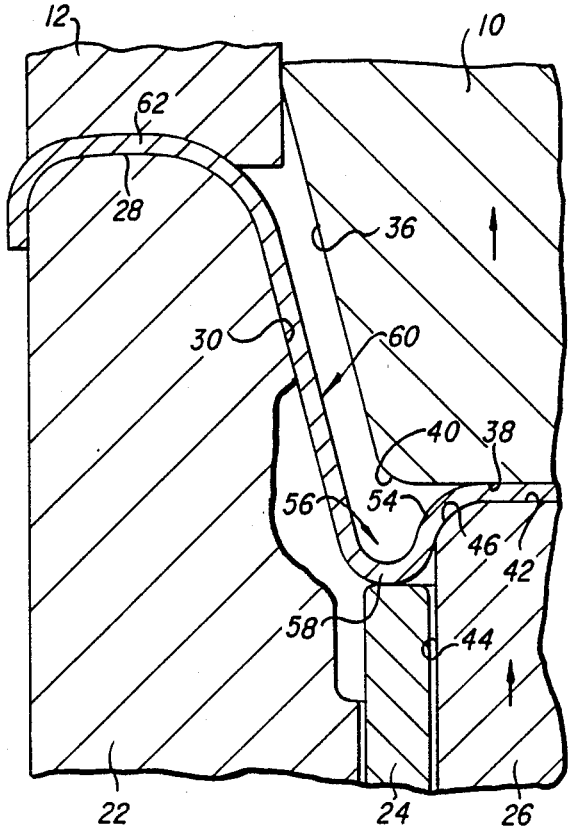
FIG. 6 is an enlarged fragmentary sectional view similar to FIG. 5 and shows the manner in which the shell is reformed by moving the center panel upwardly between the punch core and the die core to form the countersink

Referring now to FIG. 6, it will be seen that after the tooling has reached the position of FIG. 5, the ring coupled to the punch core 10 begins to pull away from the press base taking with it the punch core 10. It will be followed in its upward direction by the die core 26 as is clearly shown by the arrow in FIG. 5.

As the punch core 10 and the die core 26 move upwardly in unison, the panel center PC also moves upwardly and begins to reform around the top of the die core 26. Further, the radius 52 previously formed around the radius 40 of the punch core 10 begins to reform and to reduce in diameter.

As the panel center PC is continued to be moved upwardly by the joint action of the punch core 10 and the die core 26, a radius 54 is formed around the radius 56 with the radius 54 defining the periphery of the panel center PC. The net result is that there is formed a countersink, generally identified by the numeral 56 which depends downwardly in surrounding relation around the top part of the die core 26. At the same time, the length of the chuck wall CW is reduced. The resultant countersink 56 includes a lower bight portion 58 which is directly connected to the radius 54 on the inner side thereof and to the lower edge of the chuck wall CW on the outer side thereof.

During the various forming operations, the upper part of the piston 24 engages the countersink 56 as it is being formed.

The resultant end unit, which is generally identified by the numeral 60, includes an outer seaming flange 62 which is carried by the chuck wall CW and with the chuck wall CW being joined to the reduced diameter panel center PC by the countersink 56.

Figure 7:
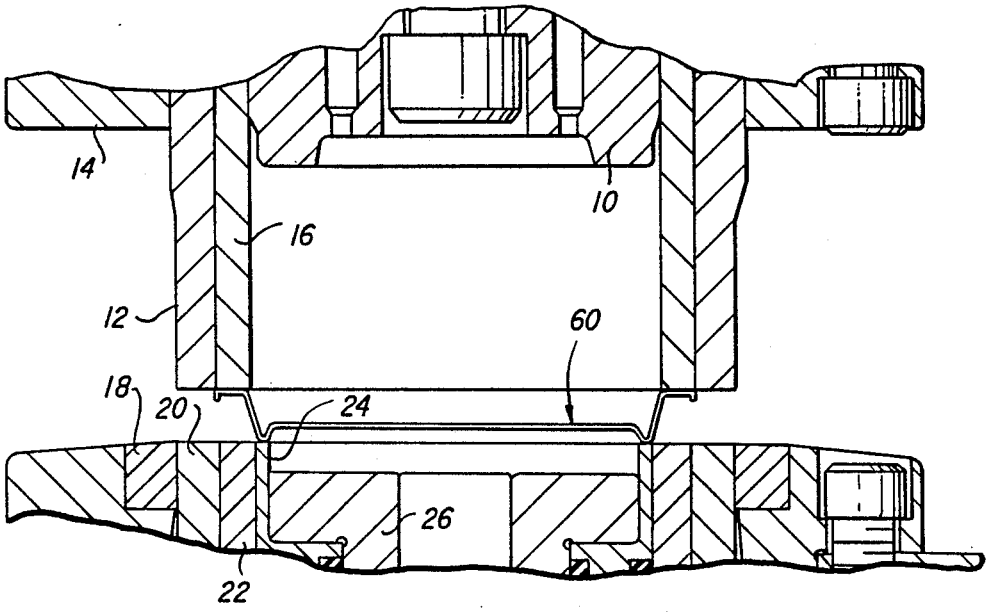
FIG. 7 is a fragmentary sectional view similar to FIG. 1 showing the manner in which the completed end unit is removed from the tooling.

The tooling now continues to move up until the various components of the lower half of the tooling reaches its original position as is shown in FIG. 7. The end unit 60 is now supported at the top of the bottom part of the tooling by the piston 24.

The top tooling then continues to move upwardly further until there is sufficient room to remove the completed end unit 60 and to apply a new blank B.

Tests have been conducted with respect to the end units formed with the tooling above described and it has been found that the end units consistently have the required buckle strength, the change in the method of forming the end units and the resultant structure of such end units providing for the 2–3 psi buckle strength additionally required.

Although only a preferred embodiment of the tooling and the method utilizing the same has been specifically illustrated and described herein, it is to be understood that minor variations may be made in the tooling and the method utilizing the same without departing from the spirit and scope of the invention as defined by the appended claims.

We claim:

1. A method of forming a metal end unit of the type including a radially outer seaming flange, a downwardly and radially inwardly sloping chuck wall, a center panel, and an axially downwardly countersink joining said chuck wall to said center panel, said method comprising the steps of forming a shell including said seaming flange, said chuck wall and said center panel with said center panel being lowermost and joined to said chuck wall by a radius, supporting said flange and said chuck wall by an outer die core ring, and clamping said center panel between a punch core and a die core, and while clamping said center panel between said die core and said punch core relatively axially moving said outer die core ring on the one hand and said die core and said punch core to relatively axially move said center panel and said seaming flange to shorten said chuck wall and thereby form a reversely turned countersink between said center panel and chuck wall depending below and generally surrounding said center panel.

2. A method according to claim 1 wherein in the forming of said countersink the diameter of said center panel is reduced.

3. A method according to claim 1 wherein said punch core and said die core have opposed flat faces of different diameters and the diameter of said punch core face being the greatest, and in the forming of said countersink, the shape and size of said center panel shifts from that of said punch core face to that of said die core face.

4. A method according to claim 1 wherein said punch core and said die core have opposed flat faces of different diameters and the diameter of said punch core face being the greatest, and in the forming of said countersink the shape and size of said center panel shifts from that of said punch core face to that of said die core face with the diameter of said center panel being reduced.

5. A method according to claim 1 wherein said countersink is of a U-shaped cross section including a lower bight portion joined directly to said chuck wall as a continuation of said chuck wall and to said center panel by a radius.

6. A method according to claim 1 wherein said countersink is of a U-shaped cross section including a lower bight portion joined directly to said chuck wall as a continuation of said chuck wall and to said center panel by a radius defined by said punch core.

7. A die assembly for forming a metal end unit for a can body wherein said metal end unit includes a center panel surrounded by a depending countersink, a chuck wall extending upwardly from said countersink and radially outer seaming flange carried by a chuck wall, said die assembly comprising outer tooling for shaping a flat metal blank to form an outer seaming flange, a central punch core movable axially relative to said outer tooling and in cooperation with said outer tooling to first form a shell including the seaming flange, a chuck wall and a center panel with the center panel being axially offset and recessed relative to the seaming flange, and a die core cooperable with said punch core to clamp the center panel against said punch core, and means for moving said punch core and said die core in unison in a direction the reverse of the prior movement of said punch core while clamping the center panel to reversely fold a lower portion of the chuck wall to form a countersink surrounding said die core.

8. A die assembly according to claim 7 wherein said punch core and said die core have opposed flat faces of different diameters wherein the center panel in the shell stage is of a greater diameter than the center panel in the final end unit.

9. A die assembly according to claim 8 wherein said punch core has a frustoconical body wall joined directly to said punch core flat face by a radius and said die core has a cylindrical body wall joined directly to said die core flat face by a radius.

* * * * *